US006352251B1

(12) United States Patent
De Angelis

(10) Patent No.: US 6,352,251 B1
(45) Date of Patent: Mar. 5, 2002

(54) PROCESS AND EQUIPMENT FOR REALIZING PACKS OF INTERFOLDED LAMINAR ARTICLES

(75) Inventor: Tonino De Angelis, Pescara (IT)

(73) Assignee: Fameccanica.Data S.p.A., Chieti (IT)

( * ) Notice: Subject to any disclaimer, the term of this patent is extended or adjusted under 35 U.S.C. 154(b) by 27 days.

(21) Appl. No.: 09/610,480

(22) Filed: Jul. 5, 2000

(30) Foreign Application Priority Data

Oct. 15, 1999 (EP) ..... 99830650

(51) Int. Cl.[7] ..... B65H 45/24

(52) U.S. Cl. ..... 270/39.06; 270/40; 493/356; 493/405; 493/441

(58) Field of Search ..... 270/32, 39.01, 270/640, 39.02, 39.05, 39.06, 39.07; 493/356, 257, 258, 361, 405, 423, 441, 451

(56) References Cited

U.S. PATENT DOCUMENTS

| | | | | | |
|---|---|---|---|---|---|
| 2,403,971 | A | * | 7/1946 | Fried | 270/39.06 X |
| 3,845,948 | A | * | 11/1974 | Furbeck et al. | 270/40 |
| 4,061,325 | A | | 12/1977 | Marcalus et al. | 270/40 |
| 4,203,584 | A | | 5/1980 | Smaw | 270/40 |
| 4,494,741 | A | | 1/1985 | Fischer et al. | 270/39 |
| 4,691,908 | A | | 9/1987 | Bradley | 270/21.1 |
| 5,195,731 | A | * | 3/1993 | Kobler et al. | 270/52.23 |
| 5,299,793 | A | * | 4/1994 | Couturier | 270/39 |
| 5,310,398 | A | * | 5/1994 | Yoneyama | 493/430 |
| 5,899,447 | A | * | 5/1999 | Muckenfuhs | 270/39.06 |
| 6,090,467 | A | * | 7/2000 | Yip | 270/39.06 X |

FOREIGN PATENT DOCUMENTS

EP 0955260 A1 11/1999

* cited by examiner

*Primary Examiner*—Christopher P. Ellis
*Assistant Examiner*—Patrick Mackey
(74) *Attorney, Agent, or Firm*—John E. Holmes; Jeffrey J. Howell

(57) ABSTRACT

A process for making packs of interleaved laminar articles, comprising the operations of:

Figure 1:
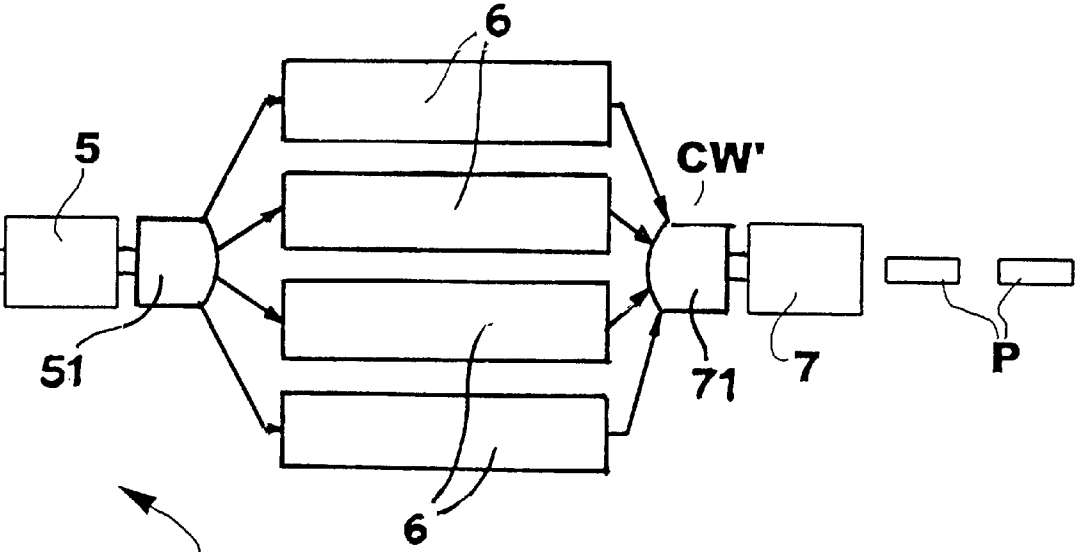

providing a first plurality of strips of laminar material, subjecting these strips to a first interleaving operation so as to create a composite strip having an interleaved structure in which the strips located at terminal positions have corresponding outer limbs which project with respect to the said composite strip, cutting the composite strip into lengths through a transverse cutting operation so as to give rise to successive separate lengths of the said composite strip, and subjecting a second plurality of the said pieces to a second interleaving operation performed by making use of the said projecting limbs so as to give rise to a further composite strip comprising interleaved strips in a number identified by the product of the said first and the said second pluralities.

14 Claims, 5 Drawing Sheets

PROCESS AND EQUIPMENT FOR REALIZING PACKS OF INTERFOLDED LAMINAR ARTICLES

This invention relates in general to the making of packs of interleaved (or interfolded) laminar articles.

A classic example of such an article comprises "paper" handkerchiefs (in fact these are usually cellulose wadding or what is known as a non-woven fabric, depending upon whether the handkerchiefs are dry or premoistened—the so-called "wet wipes" or, to use other current terms, "moist wipes" or "facial tissues") placed in corresponding box or envelope packages. The purpose of the interleaved arrangement of the individual articles is that the removal of one handkerchief from the pack automatically positions the next handkerchief in the pack so it can be pulled out.

The arrangements currently used to provide interleaved pack products are essentially based on two fundamental types.

A first arrangement is based on the concept of causing two strips or webs of sheet material to move forwards in positions facing each other. The two strips are subjected to a folding operation (and cutting, to separate the individual handkerchiefs) in positions facing each other so that the loops in the shapes—normally V or Z shapes—imparted to the handkerchiefs obtained from one or other of the two strips are at least partly interlinked. The result of this operation is the formation of a kind of chain of interleaved handkerchiefs of virtually indefinite length. The individual packs are then formed by merely introducing a break in the continuity of the chain. Documents U.S. Pat. No. 4,494,741 and U.S. Pat. No. 4,691,908, for example, provide examples of this arrangement.

The effectiveness of this arrangement is in fact impaired, particularly in view of the speed and complexity of the equipment required for implementing it, by the intrinsic complexity of the operation which causes the two strips to adopt a shape with interlinked loops. This operation is made even more complicated by the need to perform the cutting operation which results in separation of the individual handkerchiefs at the same time.

Another arrangement, which can be defined as being based on a principle of in-line operation, provides for forming a certain number of strips (or webs), for example by means of corresponding cutting operations performed simultaneously on a starting spool, in a number equal to that of the number of interleaved articles contained in the pack which it is intended to produce. The abovementioned strips are positioned into the desired conformation to ensure interleaving and are caused to converge towards a station where they are interleaved. As a result a composite strip or web comprising the interleaved starting strips is obtained. The composite strip obtained in this way is then cut to length at predetermined distances, and each length so obtained comprises a pack or block of interleaved laminar articles.

This arrangement overcomes the intrinsic limitations of the complexity and slowness of the arrangement described earlier, but pays for this advantage in terms of the general complexity of the system, in particular when the number of interleaved articles becomes large (e.g. 250 interleaved handkerchiefs, a format which is quite widely used in industry). There is therefore an intrinsic limit on flexibility given the fact that consumer requirements, in terms of the number of articles included in a single pack, are very variable, with contents ranging, for example, from a few units to more than two hundred units. Equipment operating on the basis of the arrangement described as the "in-line" arrangement can be converted to make packs containing a smaller number of articles once it has been configured to make packs containing a certain number of interleaved articles. It is not however possible to convert the equipment to make packs containing a larger number of interleaved articles. In any case reduction of the number of interleaved articles also requires fairly complex reconfiguration work (deactivating the sources of strip delivery and feed which are surplus to the number desired, etc.), which is hard to envisage in circumstances where conversion of the equipment's operation is required for only a short period of time, for example for the manufacture of a small batch of products.

Yet another arrangement is described in European patent application 98830267.5, which is used as a model for the precharacterizing portion of claims 1 and 6. This arrangement provides for the making of a composite strip or web comprising a certain number of strips interleaved "in-line" from which two projecting branches or limbs project on opposite sides at terminal positions. The composite strip formed in this way is subjected to a transverse cutting operation performed in such a way as to give rise to breaks in continuity in an alternating sequence on the two projecting limbs so as to form easily breakable connecting bridges between adjacent blocks of interleaved products. The structure formed in this way is then subjected to folding in a general zigzag arrangement. In this way a final product comprising a pack of interleaved products is obtained and in fact comprises a plurality of blocks, each in themselves comprising a certain number of interleaved products, with adjacent blocks connected by the aforesaid bridges. The pack is inserted into a packaging such as e.g. an envelope or rigid-walled container and the products can then be removed by the consumer without the latter being aware of the existence of the aforesaid bridges, which break when the first product from each pair of products connected by such a bridge is removed from the pack. In practice the user is not aware of the fact that now and then (that is when passing from one block of products to the adjacent block within the pack) the product which is removed at the time is not interleaved with the next but connected to it by a bridge which breaks in the act of removing it.

The purpose of this invention is to provide an alternative arrangement which combines within it the positive features of all the arrangements described above, that is the simplicity and efficiency of the "in-line" arrangement, the flexibility of the arrangement based on the formation of a chain of interleaved products of indefinite length, and also the high flexibility and modular nature of the arrangement which provides for the formation of packs as complexes of blocks connected together by means of breakable bridges. All this however by giving rise, as a final result, to packs of products which are interleaved in a wholly uniform manner.

In accordance with this invention this object is accomplished by means of a process and equipment having the features claimed in the appended claims.

Figure 2:
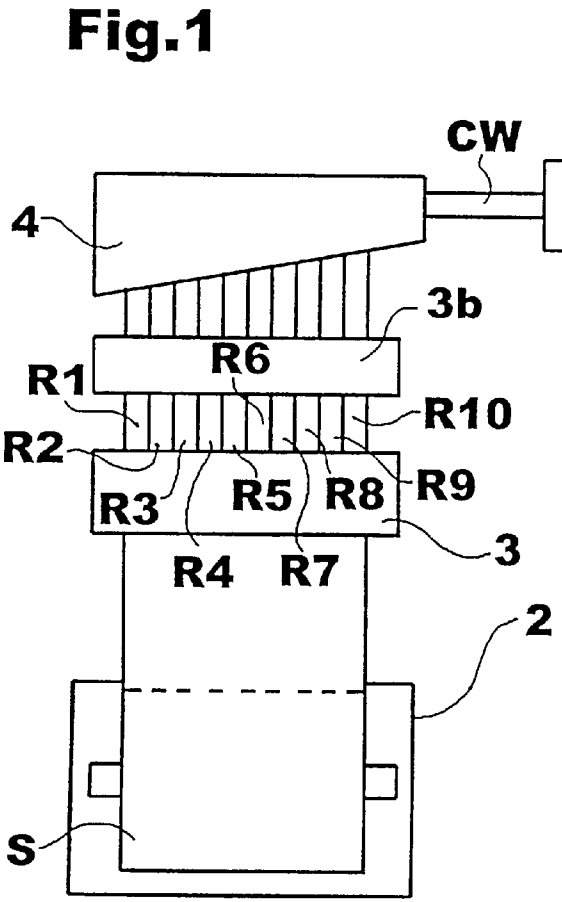
Figure 2:
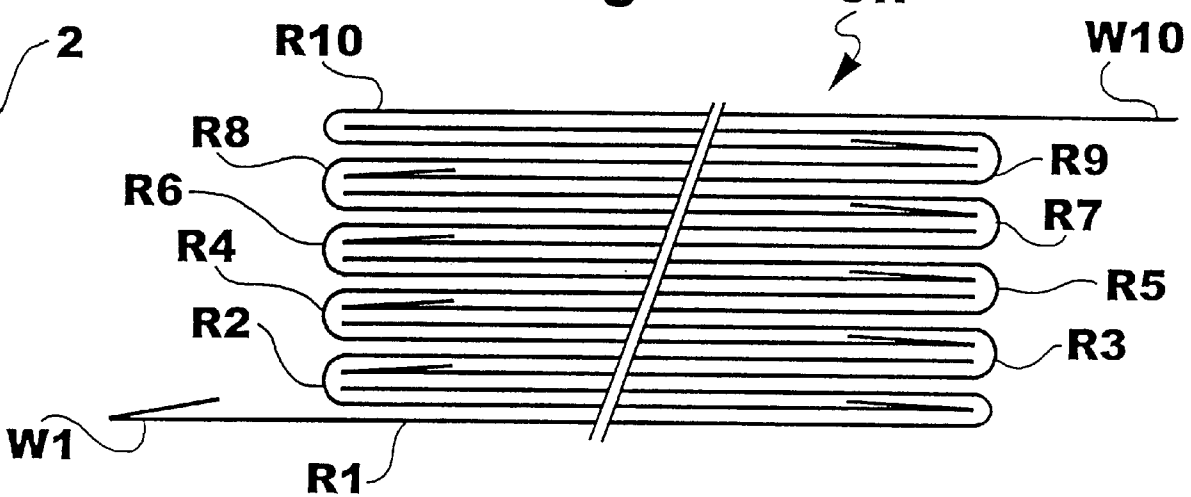
Figure 3:
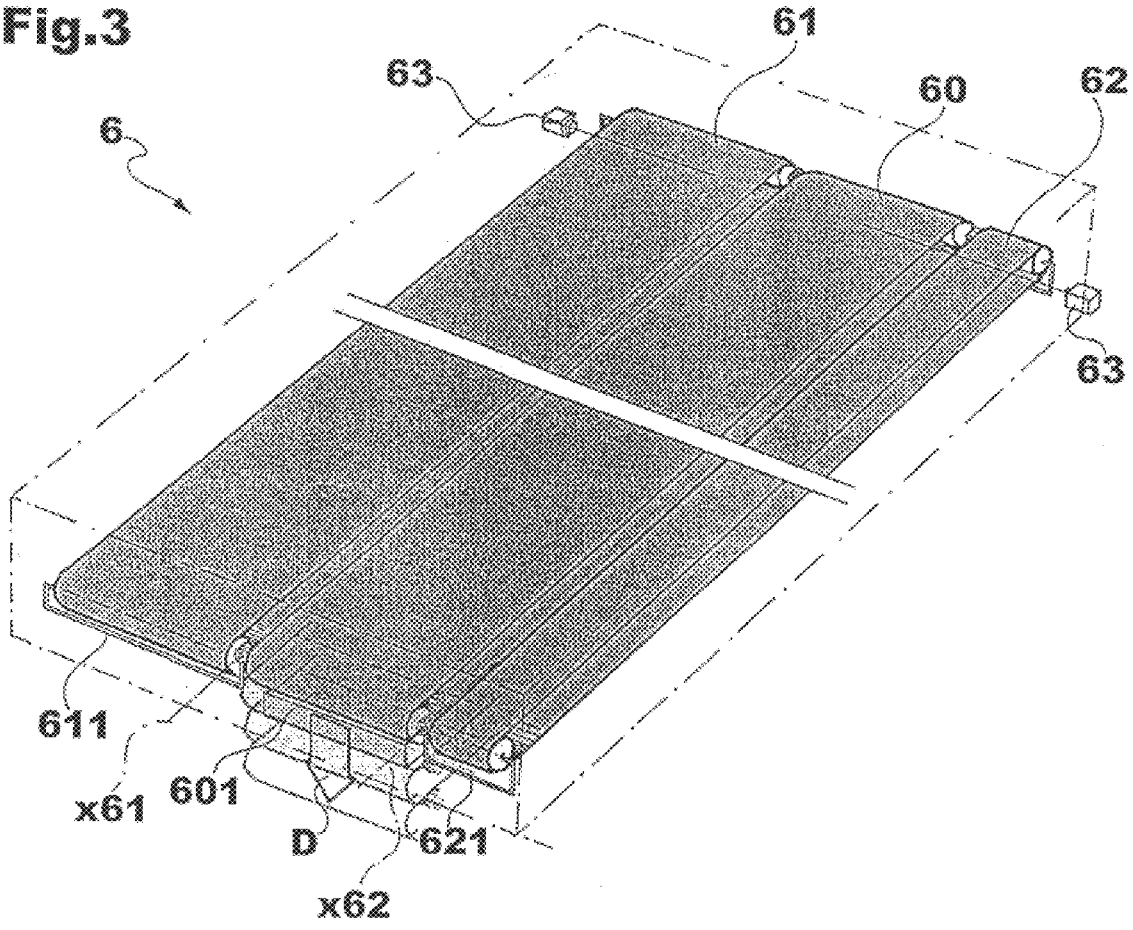

The invention will now be described, purely by way of a non-restricting example, with reference to the appended drawings, in which:

FIG. 1 shows the structure of equipment according to the invention in a general diagrammatical plan view, FIG. 2 illustrates the structure of an intermediate product manufactured within the scope of the equipment, in diagrammatical terms for clarity of illustration, FIG. 3 illustrates the structure and the operation of one of the parts of the equipment in FIG. 1, and FIGS. 4 to 8 represent subsequent stages in the implementation of the process according to the invention implemented by the device in FIG. 3.

In FIG. 1, reference number 1 indicates as a whole an item of equipment used to make packs of interleaved laminar articles. In a typical embodiment these may be handkerchiefs (which are dry or, with reference to a preferred field of application of the invention, premoistened).

Equipment 1 comprises a number of stations or working units in cascade arrangement along the line of flow which results in the formation of packs P of individual interleaved articles from a starting material comprising a spool S of laminar material (e.g. cellulose wadding or a so-called non-woven fabric, which may be premoistened or subsequently moistened).

The first station or unit in the equipment is for all purposes similar to the corresponding station in a device for the making of interleaved articles operating in accordance with the arrangement defined as the "in-line" arrangement described extensively in the introductory part of this description.

In particular, the station in question comprises a device 2 to support spool S and unwind it in a controlled way towards a longitudinal cutting device 3. Here the laminar material on spool S is subdivided, in a known way, into a plurality of strips R1, R2, . . . , Rn, which advance in parallel towards a shaping/interleaving device 4.

For reasons which will be better understood below, the number n of strips obtained by cutting spool S is on the whole small (a typical value of n may, for example, be ten), which is usually very much less than the number of strips present in an in-line interleaving device of the conventional type, where the number n in fact identifies the number of articles included in the interleaving system (which can be quite high, even of the order of one hundred or more).

After, if appropriate, passing through a moistening device 3*b* (not present in the situation where non-premoistened handkerchiefs are involved, or in the situation where spool S already comprises premoistened material), strips R1, . . . , R10 advance towards shaping/interleaving device 4 (the so-called "folder", of known structure) where strips R1, . . . , R10 are combined together into a composite interleaved strip or web CW which has the profile shown diagrammatically in FIG. 2 in transverse cross section.

In particular, in the embodiment illustrated here, which is such that it is assumed that ten strips R1, . . . , R10 are present and are each folded into a general G-shaped profile in the interleaving operation. The profile imparted to an individual strip may however be of a different type, for example V, U, C or Z-shaped.

An important feature of the arrangement according to the invention is provided by the fact that the strips located in terminal positions in the interleaving arrangement (thus, normally, the first and last strip R1 and R10 within the scope of composite strip CW) are folded in such a way that they have a corresponding limb (normally the outer limb with respect to the composite interleaved strip CW) which projects laterally with respect to the cross-sectional profile of the aforesaid composite strip.

The abovementioned outer limbs (indicated by W1 and W10 respectively) project on opposite sides with respect to composite strip CW. In addition to this, one of the aforesaid outer strips (that indicated by W1 in the example illustrated) is in turn folded into a general V-shaped profile; this results merely from the shaping imparted to corresponding strip R1 as a whole.

This decision, although not imperative for the purposes of implementing the invention, makes it possible to achieve as a final result (in accordance with means better described below) a pack comprising a number k of products which are interleaved in a wholly uniform way, that is with a form of folding/interleaving which is virtually identical for all the products in the pack. It is however obvious that in the case where strips R1, . . . , R10 are folded into a different profile in device 4, the profiling of limb W1 may also be different. For example, the limb in question may be merely flat (and therefore free of folding lines) or folded in an arrangement other than a V-shaped arrangement, having for example a Z fold or a V or U fold with asymmetrical limbs. What has been said above also applies identically to limb W10.

The means adopted within the scope of unit 4 to impart the abovementioned folding to the two terminal strips R1 and R10 (selected from a number of alternatives depending on specific requirements) corresponds to the current knowledge of those skilled in the art of the corresponding technology and does not need to be illustrated in detail here.

Composite strip CW, in the example illustrated comprising ten individual interleaved strips, is delivered to a cutting unit 5 of a known type, e.g. with counter-rotating knives. Unit 5 is designed to cut composite strip CW into individual lengths each having a length corresponding to a multiple of the final length which it is intended that the individual interleaved products collected in pack P should have (in principle the value of the multiple may also be equal to unity).

For example, assuming that it is desired to make handkerchiefs or towels of a length of 20 cm (measured in a direction corresponding to the direction of advance of composite strip CW) as interleaved products, the length of the pieces formed by cutting unit 5 may be 3 m, that is 15 times the length of the individual product. Of course these figures are purely indicative.

The pieces resulting from the action of cutting unit 5 are delivered to one or more secondary interleaving units indicated by 6. Each unit 6 has the function of receiving the pieces in sequence to combine them in turn in accordance with a general (secondary) interleaving system making use of the presence of projecting limbs W1 and W10 within the scope of each piece.

The detailed description provided below refers to the structure and the operating requirements of one of these units 6, a structure and requirements which are assumed to be preferably adopted identically in all the other units illustrated in FIG. 1.

The fact that, in a preferred way, more than one unit 6 is present (e.g. a number of four) is intended to take into account the fact that while the process of forming and cutting composite strip CW takes place in accordance with requirements of substantial continuity, the operation of individual units 6 is of a substantially discontinuous nature, as will be better seen below. The availability of more than one unit 6 which are capable of operating in parallel is therefore shown to be advantageous in that it makes it possible to subdivide or sort the flow of pieces originating from cutting unit 5 to various units 6 on the basis of a periodical distribution system by means of a distributor device 51 (of a known type). This arrangement operates in such a way that once one cycle of distribution of the pieces to the various units 6 has been completed, the immediately following piece in the flow originating from cutting unit 5 can be sorted or delivered to the unit 6 which was served first in the previous distribution cycle. With adequate coordination of the rate of flow of the pieces leaving cutting unit 5, the speed of operation and the number of units 6, this unit will then be available to receive this immediately subsequent piece which is intended to constitute the first piece in a new distribution cycle.

In complementary manner, the pieces of secondary composite strip CW' (produced by unit 6 in accordance with criteria better illustrated in the following) are reassembled in a continuous or substantially continuous flow by a device 71 (also of a known type) in order that a subsequent cutting operation can be performed.

In the embodiment illustrated, which refers to the embodiment of the invention currently preferred, the core of each unit 6 essentially comprises three components, at least some of which comprise driven belts (of a known type) identified by reference numbers 60, 61 and 62. The conveyors in question can receive the pieces as they move forward, that is in the direction of and synchronously with the forward movement with which these pieces arrive from unit 5 through distributor device 51. Although this description makes reference to an arrangement in which all three components 60, 61 and 62 comprise motor-driven belts, it will however be appreciated that, at least as far as component 62 is concerned, it is also possible to make use of different arrangements capable of ensuring the overturning function described below without this being accompanied by the capacity of performing a true and proper action of longitudinally conveying pieces of composite strip CW.

Of the motor-driven belts 60, 61 and 62 (the corresponding motor drive means are not explicitly shown in the drawings), that indicated by 60 is designed to receive the product from the secondary interleaving operation in a way which will be better described below. All this with the possibility (which is not imperative, but advantageous for the purposes of implementing the invention) of being able to perform a general lowering movement (arrow D in FIG. 3) so as to take into account the gradual increase in the thickness of the product deriving from the aforesaid secondary interleaving operation.

The other two motor-driven belts 61, 62 are instead borne by corresponding structures 611 and 621 (of a known type, and therefore shown only diagrammatically in the appended drawings) which enable belts 61, 62 to each perform an overturning movement against belt 60 which is located in the central position. This takes place around the corresponding horizontal overturning axes X61 and X62, which are substantially coextensive with the direction in which the pieces advance. Axes X61 and X62 are located in positions alongside belt 60, and the corresponding overturning movement takes place under the effect of corresponding overturning motors (not illustrated, but of a known type).

In the or each unit 6, the sequence of secondary interleaving operations shown diagrammatically in the sequence in FIGS. 4 to 8 is performed on the pieces deriving from the cutting action performed by unit 5. This takes place under the control of a programmable control unit—not illustrated, but of a known type, including as regards programming requirements—such as for example a so-called programmable logic controller (PLC) or an equivalent unit.

In order that the performance of these interleaving operations should be better understood it is sufficient to recall the fact that essentially three elements are present in composite strip CW deriving from the primary interleaving action performed in unit 4 (as in the pieces obtained in unit 5 from this composite strip CW), that is:

- a body indicated by reference C (or C', in relation to the second piece considered) indicated in FIGS. 4 to 8 corresponding to the whole of strips R1, . . . , R10 interleaved in the primary interleaving, with the exclusion of projecting limbs W1 and W10,
- a first projecting limb W1, W1' (which in the embodiment illustrated here is folded back on itself in a V shape), and
- the other projecting limb W10, W10' (which in the embodiment illustrated here is extended, and therefore free of fold lines).

Figure 4:
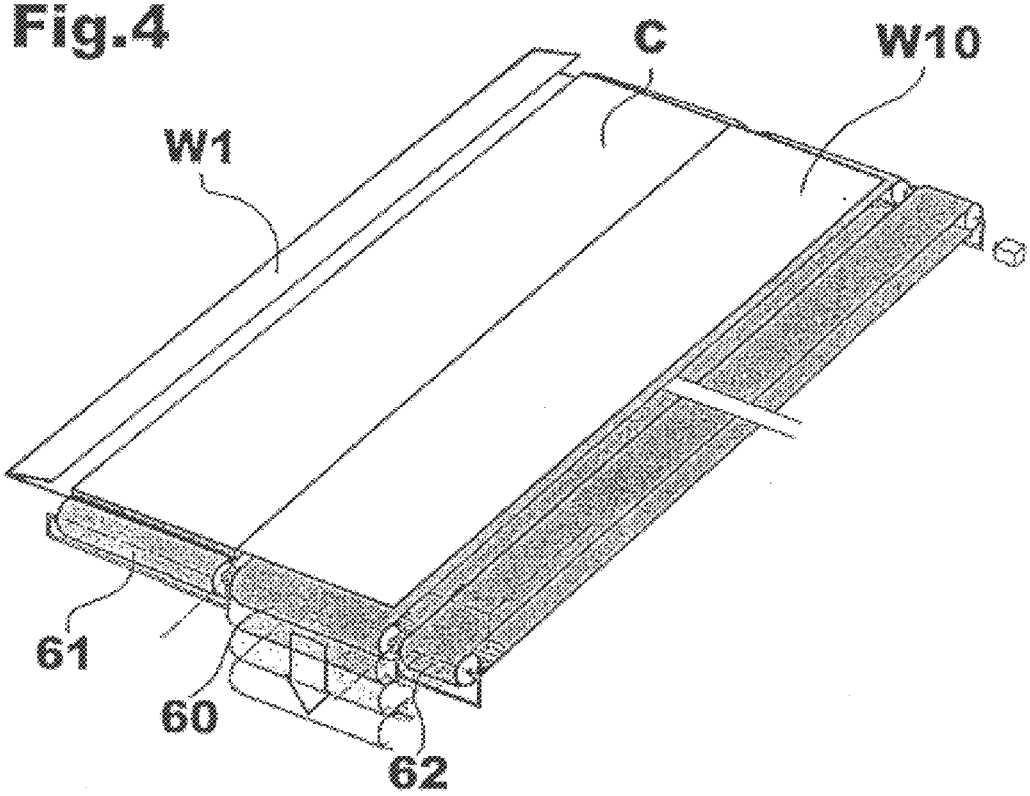

It is assumed that the individual lengths of composite strip CW enter unit 6 in the position illustrated in FIG. 4, that is with body C placed on conveyor 61, limb W1 (which is here assumed to be located at the lower end of body C with the folded portion turned back onto its upper surface) freely supported by body C and limb W10 supported by conveyor 60.

As the corresponding piece is an element of final length it is assumed that belts 60, 61, 62 are of a length corresponding to the length of the piece. All this with the further presence of registering means (of a known type and e.g. comprising optical barriers 63 which are illustrated in FIG. 2 only). These registering means—which can of course also be constructed in different ways, e.g. using mere stops—act together with the motor drives for belts 60, 61 and 62 so that the forward movement of the pieces obtained Liz from strip CW stops, when, for example, the ends of the pieces occupying the leading position in the forward movement are located so as to correspond to optical barriers 63. This condition corresponds to correct positioning of the pieces in unit 6 with a view to performance of the various operations described below, which are therefore preferably performed using pieces of strip CW which are stationary and "in register" with detectors 63.

Figure 5:
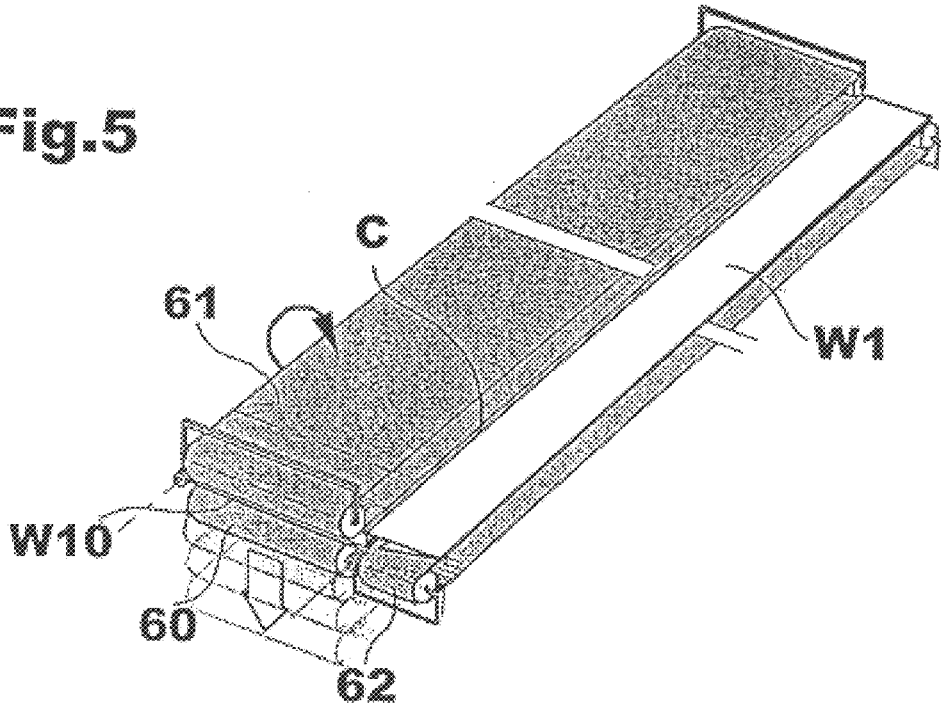
Figure 6:
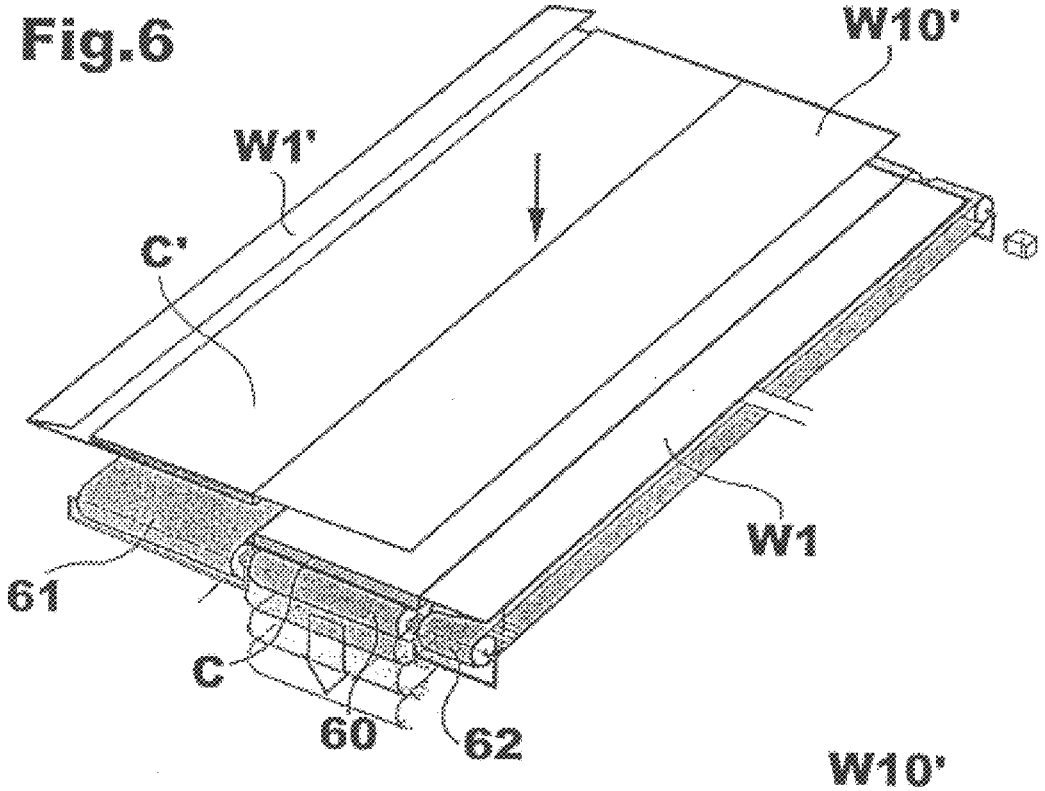
Figure 7:
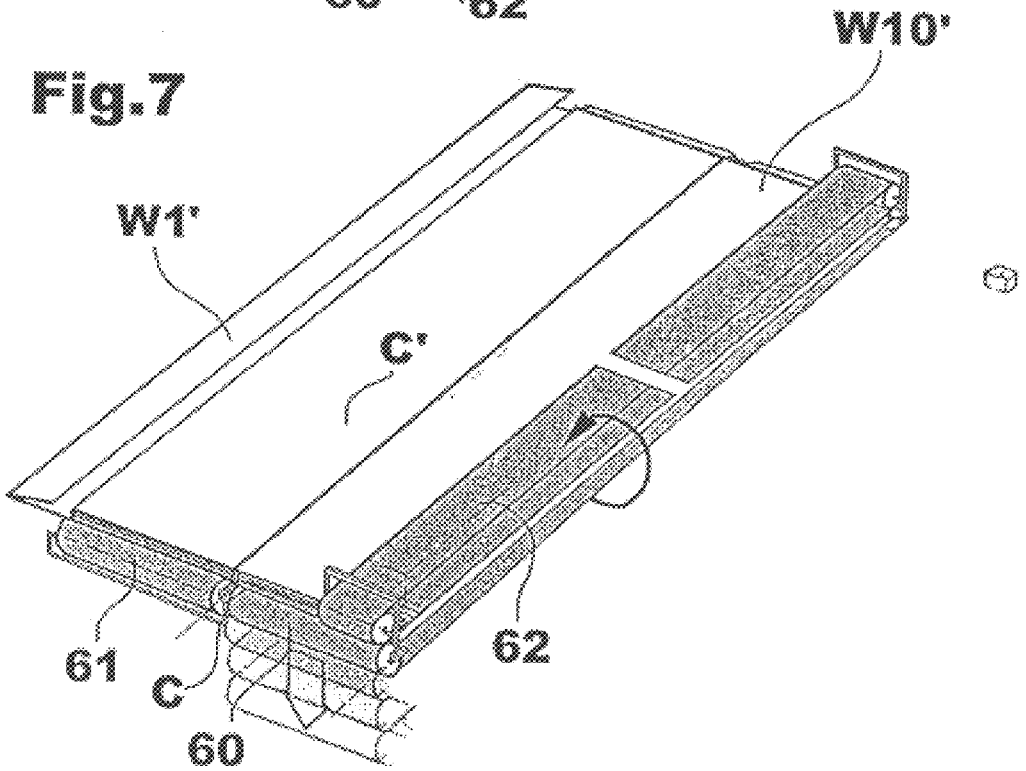

Once the configuration to which reference has been made in FIG. 4 is achieved, the overturning motor drive for belt 61 is activated so as to carry body C (and limb W1 projecting from it) over above limb W10 so as to achieve the folded position shown in FIG. 5. In this situation body C overlies limb W10 supported on belt 60 with limb W1 now arranged in a position with respect to limb W10 which is exactly opposite that which it occupied in the starting conditions illustrated in FIG. 4.

When it has reached this position, following possible slight lowering of belt 60 in order to take into account the vertical offset effect desired and to take into account the gradual growth of the pack of interleaved products which is being formed in this way, a new piece obtained from composite strip CW through the effect of the sectioning action performed by action is introduced into unit 6 in ways which are wholly identical to those described above. This new piece also comprises a body C' from which two end limbs W1' and W10' project.

This introduction movement is such that (see FIG. 6) limb W10' of the new piece introduced into unit 6 lies over the upper surface of body C of the piece already present in unit 6 while body C' of the new piece introduced and projecting limb W1' of the new piece introduced for the moment occupy positions similar to those of body C and limb W1 illustrated in FIG. 4.

At this point the overturning motor drive for belt 62 is activated so as to carry limb W1 of the first piece introduced into unit 6 so that it is folded over limb W10' of the second piece of composite strip CW which has just been introduced into unit 6. All as shown diagrammatically in FIG. 7.

The overturning motor drive for belt 61 is then activated in the same way as previously described with reference to FIG. 5. The overall result is to cause body C' of the new piece introduced into unit 6 to turn back over belt 60, that is above the piece of strip previously introduced into unit 1.

This operation has the effect that body C' of the new piece of strip CW introduced into unit 6 is overturned onto body C of the piece previously introduced, but capturing limb W1 of the first piece introduced into unit 6 in a position between the two bodies C and C' and interlinked with limb W10' of the second piece.

Figure 8:
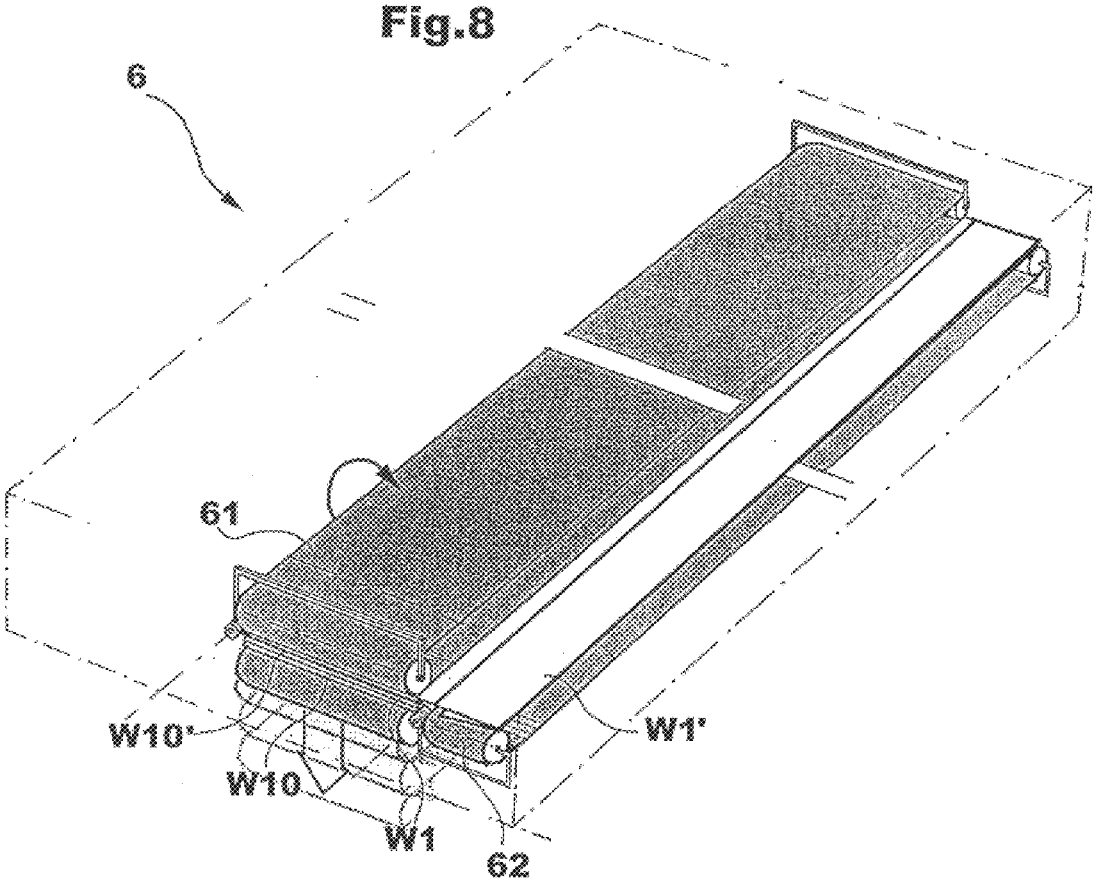

It will immediately be appreciated that, with the exception of the gradual accumulation of the two pieces of strip introduced successively into unit 6, the configuration of elements shown in FIG. 8 essentially corresponds to the relative arrangement of the parts illustrated in FIG. 5, in particular the presence of a new limb W1' located above belt 62 while body C' and limb W10' of the piece of strip introduced second into the machine are now stacked above belt 60 in a condition in which they are interleaved with the first piece of strip.

At this point the sequence of operations illustrated in FIGS. 4 to 8 can be repeated a number of times m so as to obtain as a final result (following final overturning of limb W1 which still results in a projecting position) a pack of interleaved products produced by the secondary interleaving of a second plurality, equal to m, of pieces formed through the effect of the cutting action performed in unit 5. These pieces each in turn comprise a first plurality n of interleaved sheets.

The interleaving operation performed in unit 6 substantially comprises the stages of:

providing at least a first and a second piece of the aforesaid second plurality m each having a body C, C' and a corresponding first projecting limb W1, W1' and a corresponding second projecting limb W10, W10', and joining the first and second pieces in an interleaved condition with the first projecting limb W1 of the first piece and the second projecting limb W10' of the second piece folded back into a position in which they are interlinked and located between the said first and second pieces which are joined together.

More specifically, this operation comprises, in order, the stages of:

positioning the first piece with body C overturned onto corresponding second limb W1 which is folded back onto the body and corresponding first limb W1 continuing in a projecting condition (FIG. 5), placing the second limb W10' of the second piece onto body C of the first piece (FIG. 6), folding the first limb W1 of the first piece onto corresponding body C interlinking it with the second limb W10' of the second piece (FIG. 7), and positioning the second piece with body C' overturned against the corresponding second limb W10' interlinked with the first limb W1 of the first piece (FIG. 8).

The result of the aforesaid secondary interleaving operation is therefore to form a composite secondary strip CW' in general comprising a number k of sheets interleaved together—in a precisely uniform way.

The abovementioned number k can be expressed by the relationship k=n.m, where:

n represents the primary order of interleaving, that is the number of strips R1, . . . , R10 (in the embodiment illustrated n=10) interleaved in folding device 4, and m represents the number of pieces interleaved with each other—in the secondary interleaving—in unit 6.

The subsequent composite strip CW' leaving unit or each unit 6 (corresponding to the result of the secondary interleaving operation and therefore comprising successive pieces of lengths equal to a multiple of the length of the individual product which it is desired to obtain as the final result of the interleaving operation) is finally fed to a cutting unit 7 (also of a known type) by means of bundling device 71.

Unit 7 cuts the pieces of composite strip CW' originating from units 6 into individual packs P of length equal to the final length of the interleaved products.

Packs P (which are intended to be delivered to a packaging station, which is not illustrated, but of a known type) each comprise a number k of products which are interleaved in a completely uniform way; as already mentioned, this expression is intended to indicate the fact that all k products obtained in the pack are connected together in accordance with a system of interleaving which is precisely the same throughout the entire extent of the pack, and therefore without any local differences resulting e.g. from the possible presence of breakable bridges provided to connect subsequent blocks of products comprising the pack.

As a possible variant embodiment it is also possible to avoid re-assembling the pieces of secondary composite strip CW' by providing a corresponding cutting unit 7 at the outlet from each unit 6, thus performing the re-assembling on the various flows of packs p generated in this way,or completely avoiding the aforesaid re-assembling, e.g. by sending the various flows of packs P generated in this way to corresponding packaging lines (not illustrated).

From what has been said above it will be appreciated that the arrangement according to the invention offers a high degree of flexibility in determining the number k.

Once the number n has been fixed (in the embodiment illustrated it is assumed that n is equal to 10, but this choice is not in fact imperative, given that different values can be selected, such as, e.g. n=5 or n=20, etc.), the number of products k included in the pack obtained as the final result can be varied—to a level of distinction identified by the value of n—purely by acting on unit 6 in such a way as to selectively alter the number m of subsequent pieces of composite strip CW which are overlapped in the secondary interleaving action in the ways illustrated in FIGS. 4 to 8.

These figures show how in unit 6 it is sufficient to have only the elements which are essential for interleaving two pieces CW, with the possibility that this operation can be repeated up to the interleaving of m pieces.

In the exemplary embodiment illustrated here (which—it is emphasized—is only that and must not in any way be interpreted as limiting the scope of the invention) these elements comprise a single complex of belts 60, 61, 62 which are capable of receiving successive pieces of strip CW to then perform the overturning and interleaving operation illustrated in the sequence of FIGS. 4 to 8.

Changing the number m does not therefore require work to modify the structure of unit 6. By merely taking action (and in a known way, on the basis of criteria which do not require a detailed description here) it is therefore possible to act such that the said secondary interleaving unit 6 can operate, even in rapid succession, on products which are intended to be interleaved into packs having different values of k. All this without requiring modifications of any kind or adjustment work to the structure of unit 6.

In connection with the presence of a plurality of secondary interleaving units 6 (present in the number four in the example illustrated), those skilled in the art will understand that the aforementioned units 6 can be operated either wholly or even only partly in parallel, such partial operation corresponding to the use of only one of these units, depending on specific production requirements.

Of course, while the principle of the invention remains unchanged, details of embodiments and forms of implementation may be widely varied in comparison with what has been described and illustrated without thereby going beyond the scope of this invention as defined by the following claims.

What is claimed is:

1. A process for making packs of interleaved laminar articles, comprising the operations of:

providing a first plurality of strips of laminar material, subjecting the strips to a first interleaving operation so as to create a composite strip of interleaved structure with a first and a second strip of the said first plurality located at end positions in the said composite strip and having a corresponding first and a corresponding second outer limb projecting with respect to the said composite strip, and cutting the said composite strip into lengths by means of a transverse cutting operation, wherein the process comprises the operations of:

performing the said cutting operation so as to give rise to successive separate pieces of the said composite strip, and subjecting a second plurality of the said pieces to a second interleaving operation performed by making use of the said corresponding projecting outer limbs so as to give rise to a further composite strip comprising interleaved strips in a number identified by the product of the said first and the said second pluralities.

2. The process of claim 1, comprising the operation of subjecting the said subsequent composite strip to a further transverse cutting operation so as to give rise to successive packs of articles, each pack comprising laminar articles which are interleaved in a uniform way in a number equal to the said number.

3. The process of claim 1, wherein the said second interleaving operation comprises the stages of:

providing at least a first and a second piece of the said second plurality each having a body and a corresponding first and a corresponding second projecting limb, and joining the said first and second pieces in an interleaved way with the corresponding first projecting limb of the first piece and the corresponding second projecting limb of the second piece folded into a position in which they are interlinked and located between the said first and second pieces joined together.

4. The process of claim 3,comprising, in order, the operations of:

positioning the first piece with body overturned onto the corresponding second limb folded back onto the body and the corresponding first limb maintained in a projecting condition, placing the second limb of the second piece onto the body of the first piece, folding the first limb of the first piece onto the corresponding body interlinking it with the second limb of the second piece, and placing the second piece with its body overturned against the corresponding second limb interlinked with the first limb of the first piece.

5. The process of claim 1, comprising the operation of folding at least one of the said first and second outer limbs into a general V-shaped configuration.

6. Equipment for making packs of interleaved laminar articles, comprising:

a first interleaving unit for acting on a first plurality of strips of laminar material to subject these strips to a first interleaving operation and create a composite strip having an interleaved structure with a first and a second strip of the said first plurality located at the terminal positions of the said composite strip and having a corresponding first and a corresponding second outer limb projecting with respect to the said composite strip, and a cutting unit to cut the said composite strip into lengths through a transverse cutting operation, wherein the said cutting unit is configured so as to give rise to separate successive pieces of the said composite strip and in that at least a second interleaving unit is provided to subject a second plurality of the said pieces to a second interleaving operation performed making use of the said corresponding outer projecting limbs so as to give rise to a further composite strip comprising strips interleaved in a number identified by the product of the said first and the said second pluralities.

7. The equipment of claim 6, comprising at least a further transverse cutting unit acting on the said further composite strip so as to give rise to successive packs of articles by cutting the said further composite strip into lengths, each pack comprising laminar articles which are interleaved together in a uniform way in a number equal to the said number.

8. The equipment of claim 6, wherein the said at least one second interleaving unit comprises:

a receiving device for at least a first and a second piece of the said second plurality, each of the said pieces having a body and a corresponding first and a corresponding second projecting limb, and an overturning device to join the said first and second pieces in an interleaved condition with the corresponding first projecting limb of the first piece and the corresponding second projecting limb of the second piece folded into an interlinked position and located between the said first and second pieces joined together.

9. The equipment of claim 8, wherein the said at least one second interleaving unit comprises:

a first overturning device to locate the first piece with its body overturned onto the corresponding second limb folded back onto the body and the corresponding first limb remaining in a projecting condition, a receiving device to position the second limb of the second piece on the body of the first piece, a second overturning device to fold the first limb of the first piece onto the corresponding body interlinking it with the second limb of the second piece; the said first overturning device positioning the second piece with the body overturned against the corresponding second limb interlinked with the first limb of the first piece.

10. The equipment of claim 8, wherein the said receiving device comprise motor-driven conveyor members adapted for receiving the said pieces as they move forward.

11. The equipment of claim 8, wherein the said overturning device comprise motor-driven conveyor members adapted for receiving the said pieces as they move forward and have associated corresponding overturning motor drives acting about corresponding overturning axes which are substantially coextensive with the direction in which the said pieces advance.

12. The equipment of claim 8, wherein the said receiving device is at least partly capable of selectively moving in the direction of accumulation of the said pieces of the said second plurality which are interleaved through the effect of the said second interleaving operation.

13. The equipment of claim 6 also comprising a registering device for correctly positioning the pieces of the said second plurality before proceeding with the said second interleaving operation.

14. The equipment of claim 6 comprising a plurality of the said second interleaving units with an associated distributor for distribution of the said pieces separated from the said composite strip from the said cutting unit to the second unit interleaving the said plurality.

* * * * *